US010756477B2

(12) United States Patent
Kondo

(10) Patent No.: US 10,756,477 B2
(45) Date of Patent: Aug. 25, 2020

(54) CONNECTOR ASSEMBLY, CONNECTION MODULE, AND METHOD FOR MANUFACTURING CONNECTION MODULE

(71) Applicant: HOSIDEN CORPORATION, Yao, Osaka (JP)

(72) Inventor: Hayato Kondo, Yao (JP)

(73) Assignee: HOSIDEN CORPORATION, Yao-Shi, Osaka (JP)

( * ) Notice: Subject to any disclaimer, the term of this patent is extended or adjusted under 35 U.S.C. 154(b) by 0 days.

(21) Appl. No.: 16/411,787

(22) Filed: May 14, 2019

(65) Prior Publication Data

US 2019/0386425 A1 Dec. 19, 2019

(30) Foreign Application Priority Data

Jun. 13, 2018 (JP) ..... 2018-112732

(51) Int. Cl.
*H01R 13/52* (2006.01)
*H01R 12/71* (2011.01)
(Continued)

(52) U.S. Cl.
CPC ..... *H01R 13/5219* (2013.01); *H01R 12/716* (2013.01); *H01R 43/205* (2013.01); *H01R 43/26* (2013.01)

(58) Field of Classification Search
CPC ... H01R 13/5219; H01R 12/716; H01R 43/26
See application file for complete search history.

(56) References Cited

U.S. PATENT DOCUMENTS 6,482,045 B2 * 11/2002 Arai ..... H01R 13/6456 439/680
2001/0017767 A1 * 8/2001 Kitamura ..... H05K 5/0039 361/752

(Continued)

FOREIGN PATENT DOCUMENTS

EP 2736125 A1 5/2014
EP 2840666 A1 2/2015

(Continued)

OTHER PUBLICATIONS

Extended European Search Report for European Application No. EP 19170832.0, published by the European Patent Dffice (EPO), dated Nov. 7, 2019, including corresponding Communication, 6-page EPO Form 1703, 1-page Form 1503, 1-page Annex, and Information on Search Strategy.

*Primary Examiner* — Xuong M Chung Trans
(74) *Attorney, Agent, or Firm* — Kilyk & Bowersox, P.L.L.C.

(57) ABSTRACT

A connector assembly including a case, a second connector, and a sealing member. The case is combinable with a circuit board on which a first connector is mounted. The case and the circuit board are adapted to define a space. The second connector passes through the case in a direction substantially perpendicular to the circuit board. The second connector is connectable to the first connector within the space and includes an accommodatable portion to be disposed within the space. The sealing member has a tuboid shape, extends in the direction, and includes first and second portions respectively on one and the other sides in the direction. The first portion fits around the accommodatable portion of the second connector. The second portion is positioned on the other side in the direction relative to the accommodatable (Continued)

portion of the second connector and adapted to abut the circuit board and cover the first connector.

18 Claims, 13 Drawing Sheets

(51) Int. Cl.
*H01R 43/20* (2006.01)
*H01R 43/26* (2006.01)

(56) References Cited

U.S. PATENT DOCUMENTS

| | | | | |
|---|---|---|---|---|
| 2014/0148019 | A1* | 5/2014 | Sasaki | H01R 13/516 439/65 |
| 2015/0056861 | A1* | 2/2015 | Sasaki | H01R 13/665 439/620.01 |
| 2016/0150655 | A1 | 5/2016 | Takenaka et al. | |
| 2018/0006407 | A1* | 1/2018 | Sasaki | B60R 1/00 |

FOREIGN PATENT DOCUMENTS

| | | | |
|---|---|---|---|
| EP | 3264537 | A1 | 1/2018 |
| JP | 2006350187 | A | 12/2006 |

* cited by examiner

CONNECTOR ASSEMBLY, CONNECTION MODULE, AND METHOD FOR MANUFACTURING CONNECTION MODULE

CROSS-REFERENCE TO RELATED APPLICATION

The present application claims priority under 35 U.S.C. § 119 of Japanese Patent Application No. 2018-112732 filed on Jun. 13, 2018, the disclosure of which is expressly incorporated by reference herein in its entirety.

BACKGROUND OF THE INVENTION

Technical Field

The invention relates to connector assemblies, connection modules, and methods for manufacturing the connection modules.

Background Art

Conventional connector assembly includes one to be used in a camera module as disclosed in Japanese Unexamined Patent Application Publication No. 2006-350187. This connector assembly includes a circuit board, and a plug connector with a cable. The plug connector is mounted on the circuit board inside a casing of the camera module, with the cable led out of the casing. The casing has a ventilation opening, which is covered with a moisture-permeable member. The moisture-permeable member blocks moisture from the outside while allowing dissipation of heat from the circuit board to the outside.

SUMMARY OF INVENTION

However, the circuit board, provided inside such casing, is surrounded by a space filled with air. The air around the circuit board serves as a thermal insulator to hinder dissipation of heat from the circuit board to the outside of the casing.

The invention provides a connector assembly, a connection module, and a method for manufacturing the connection module, all of which contribute to improved heat dissipation.

A connector assembly according to a first aspect of the invention includes a case, a second connector, and a sealing member. The case is combinable with a circuit board on which a first connector is mounted. The case and the circuit board are adapted to define an accommodation space. The second connector passes through the case in a first direction. The first direction is substantially perpendicular to the circuit board. The second connector is connectable to the first connector within the accommodation space and includes an accommodatable portion. The accommodatable portion is adapted to be disposed within the accommodation space. The sealing member has a tuboid shape, extends in the first direction, and includes a first and a second portion respectively on one and the other sides in the first direction. The first portion fits around the accommodatable portion of the second connector. The second portion is positioned on the other side in the first direction relative to the accommodatable portion of the second connector and adapted to abut the circuit board and cover the first connector.

In the connector assembly of this aspect, the first portion of the sealing member fits around the accommodatable portion of the second connector, while the second portion of the sealing member is adapted to abut the circuit board and cover the first connector. As such, it is possible to make the second portion of the sealing member abut with the circuit board and cover the first connector when combining together the case and the circuit board such as to define the accommodation space and connecting the first connector to the second connector within the accommodation space. The sealing member thus makes it possible to fill the accommodation space with thermal-conductive resin. Hence the connector assembly provides improved heat dissipation.

The first portion of the sealing member may be integrated with the second connector.

A connector assembly according to a second aspect of the invention includes a circuit board, a first connector, and a sealing member. The circuit board is combinable with a case through which a second connector passes in a first direction. The first direction is substantially perpendicular to the circuit board. The circuit board and the case are capable of defining an accommodation space. The first connector is mounted on the circuit board and connectable to the second connector within the accommodation space. The sealing member has a tuboid shape, extends in the first direction, and includes a first and a second portion respectively on one and the other sides in the first direction. The second portion fits around at least part of the first connector and abuts the circuit board. The second portion forms a seal with the circuit board which surrounds the first connector. The first portion is positioned on the one side in the first direction relative to the at least part of the first connector and adapted to fit around an accommodatable portion of the second connector. The first portion is adapted to form a seal with the accommodatable portion of the second connector. The accommodatable portion is disposed within the accommodation space.

In the connector assembly of this aspect, the second portion of the sealing member fits around at least part of the first connector and abuts the circuit board, while the first portion of the sealing member is adapted to fit around the accommodatable portion of the second connector disposed within the accommodation space. As such, it is possible to make the first portion of the sealing member fit around the accommodatable portion of the second connector when combining together the case and the circuit board to define the accommodation space and connecting the first connector to the second connector within the accommodation space. The sealing member thus makes it possible to fill the accommodation space with thermal-conductive resin. Hence the connector assembly provides improved heat dissipation.

The connector assembly according to the second aspect may further include a case. The case may be combined with the circuit board such that the case and the circuit board define the accommodation space. The case may be configured to allow the second connector to pass through the case in the first direction. In the connector assembly of this aspect, it is possible to make the first portion of the sealing member fit around the accommodatable portion of the second connector when passing the second connector through the case combined with the circuit board and connecting the second connector to the first connector within the accommodation space. The sealing member thus makes it possible to fill the accommodation space with thermal-conductive resin. Hence the connector assembly provides improved heat dissipation.

The second portion of the sealing member may be integrated with at least part of the first connector.

The sealing member according to any of the above aspects may be made of an elastic material. In this case, the sealing member can elastically abut the circuit board, or elastically fit around the accommodatable portion of the second connector.

The connection module according to an aspect of the invention includes a circuit board, a case, first and second connectors, a sealing member, and thermal-conductive resin. The case is combined with the circuit board, and the case and the circuit board define an accommodation space. The first connector is mounted on the circuit board and accommodated within the accommodation space. The second connector passes through the case in a first direction. The first direction is substantially perpendicular to the circuit board. The second connector connects to the first connector within the accommodation space and includes an accommodatable portion disposed within the accommodation space. The sealing member has a tuboid shape, extends in the first direction, and includes a first and a second portion respectively on one and the other sides in the first direction. The first portion fits around the accommodatable portion of the second connector. The second portion is positioned on the other side in the first direction relative to the accommodatable portion of the second connector, abuts the circuit board, and covers the first connector. The thermal-conductive resin fills the accommodation space. The first connector, the sealing member, and the accommodatable portion of the second connector are embedded in the thermal-conductive resin.

The connection module of this aspect provides improved heat dissipation for the following reason. The first portion of the sealing member fits around the accommodatable portion of the second connector, while the second portion of the sealing member abuts the circuit board and covers the first connector. As such, the accommodation space, defined by the case and the circuit board, can be filled with the thermal-conductive resin. Hence heat from the circuit board and the first and the second connectors can be dissipated through the thermal-conductive resin to the outside of the case.

The sealing member may be configured, in place of the configuration that the first portion fits around the accommodatable portion of the second connector and the second portion abuts the circuit board and covers the first connector, such that the second portion fits around at least part of the first connector and abuts the circuit board, and that the first portion fits around the accommodatable portion of the second connector. In this case, the first portion may be positioned on one side in the first direction relative to the at least part of the first connector.

The connection module of this aspect also provides improved heat dissipation for the following reason. The sealing member configured as described above makes it possible to fill the accommodation space with thermal-conductive resin. Hence heat from the circuit board and the first and the second connectors can be dissipated through the thermal-conductive resin to the outside of the case.

A method for manufacturing a connection module according to a first aspect of the invention includes combining a circuit board and a case such that the circuit board and the case define an accommodation space, and connecting, within the accommodation space, a first connector mounted on the circuit board to a second connector passing through the case; and filling the defined accommodation space with molten thermal-conductive resin, and cooling and solidifying the filled thermal-conductive resin. The connecting of the first and second connectors includes bringing a sealing member, which fits around the second connector, into abutment with the circuit board and placing the sealing member such that the sealing member covers and surrounds the first connector on the circuit board.

In the manufacturing method of this aspect, the sealing member fitting around the second connector is placed such as to abut the circuit board and fit around the first connector. This makes it possible to fill the accommodation space, defined by the case and the circuit board, with thermal-conductive resin. Heat from the circuit board and the first and the second connectors can be dissipated through the thermal-conductive resin to the outside of the case. Therefore, the manufacturing method improves heat dissipation of the connection module.

Where the sealing member fits around the first connector and abuts the circuit board, instead of fitting around the second connector, the manufacturing method may be modified to include fitting the sealing member around the second connector when connecting the first and second connectors. The manufacturing method of this aspect can provide an effect similar to that obtained by the manufacturing method of the first aspect.

A method for manufacturing a connection module according to a second aspect of the invention includes inserting a second connector into an opening of a case, the case being combined with a circuit board on which a first connector is mounted, the case and the circuit board defining an accommodation space, and connecting the second connector to the first connector within the accommodation space; and filling the defined accommodation space with liquid thermal-conductive resin, and solidifying the filled thermal-conductive resin. The liquid resin may be a molten resin which solidifies on cooling or may be a liquid resin which solidifies following a chemical reaction. The connecting of the first and second connectors includes placing a sealing member, which fits around the first connector and abuts the circuit board, such that the sealing member fits around the second connector.

In the manufacturing method of this aspect, the sealing member fitting around the first connector and abutting the circuit board is placed to fit around the second connector. This makes it possible to fill the accommodation space, defined by the case and the circuit board, with thermal-conductive resin. Heat from the circuit board and the first and the second connectors can be dissipated through the thermal-conductive resin to the outside of the case. Therefore, the manufacturing method improves heat dissipation of the connection module.

DESCRIPTION OF EMBODIMENTS

Figure 1:
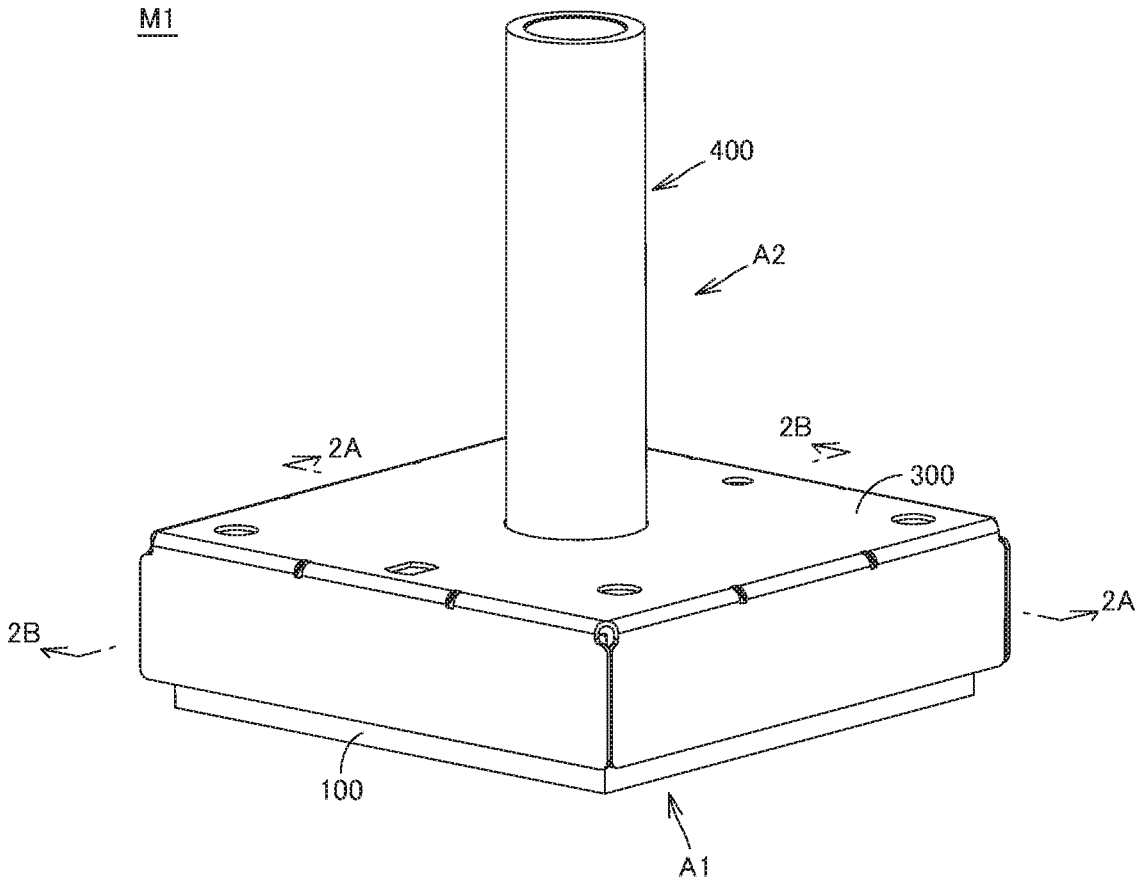
FIG. 1 is a front top right-side perspective view of a connection module according to a first embodiment of the invention.
Figure 2A:
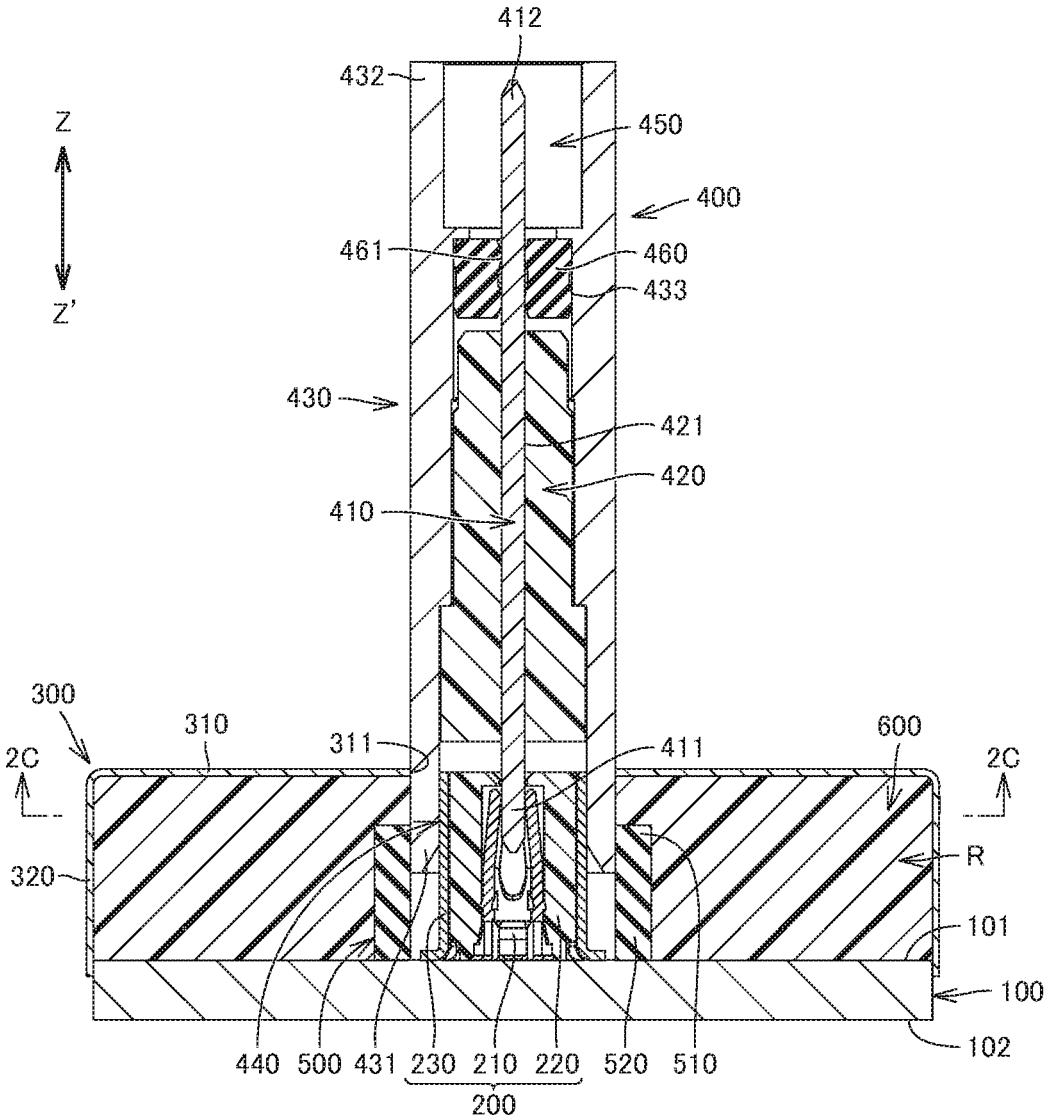
FIG. 2A is a cross-sectional view of the connection module, taken along line 2A-2A in FIG. 1.
Figure 2B:
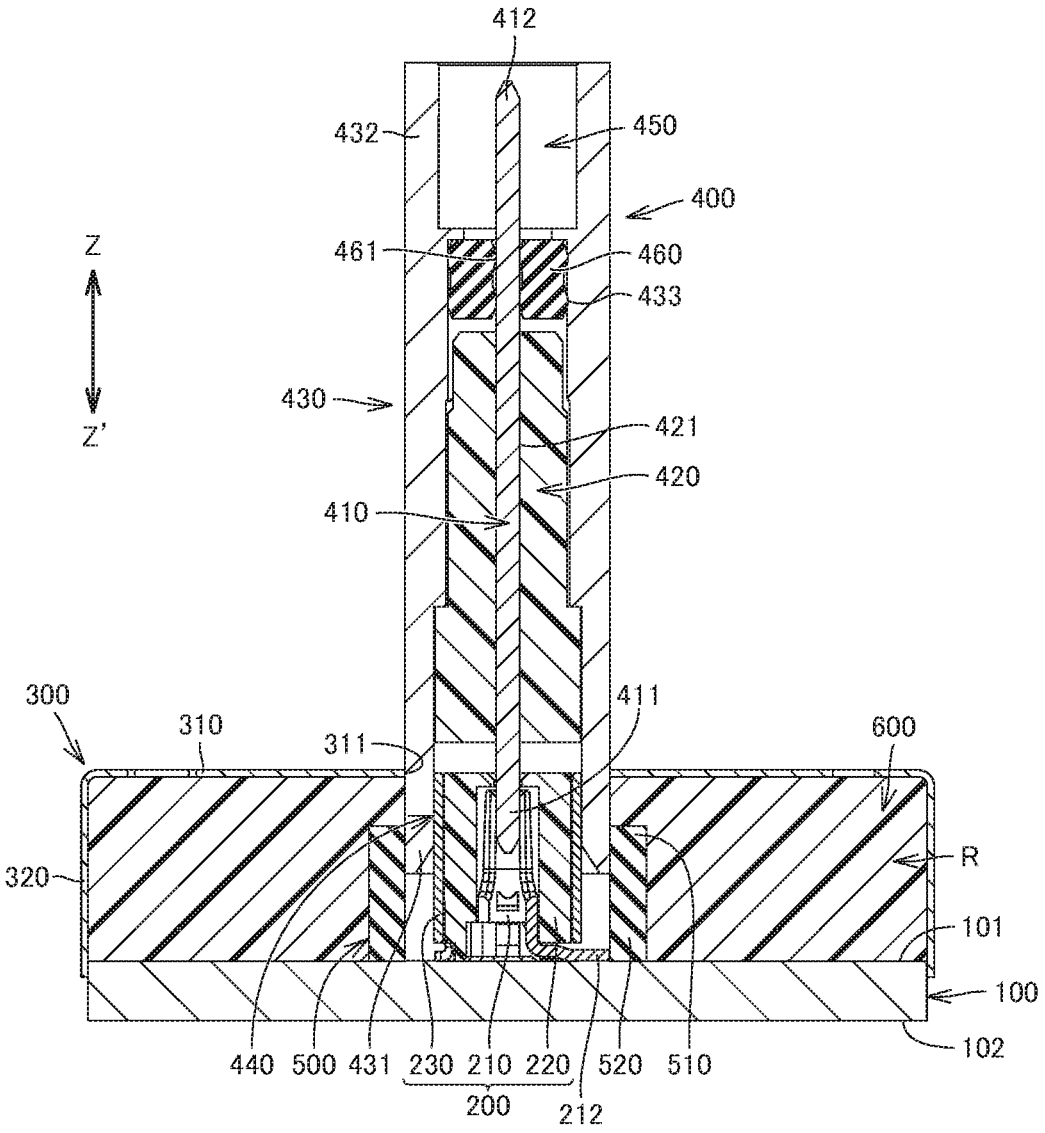
FIG. 2B is a cross-sectional view of the connection module, taken along line 2B-2B in FIG. 1.
Figure 2C:
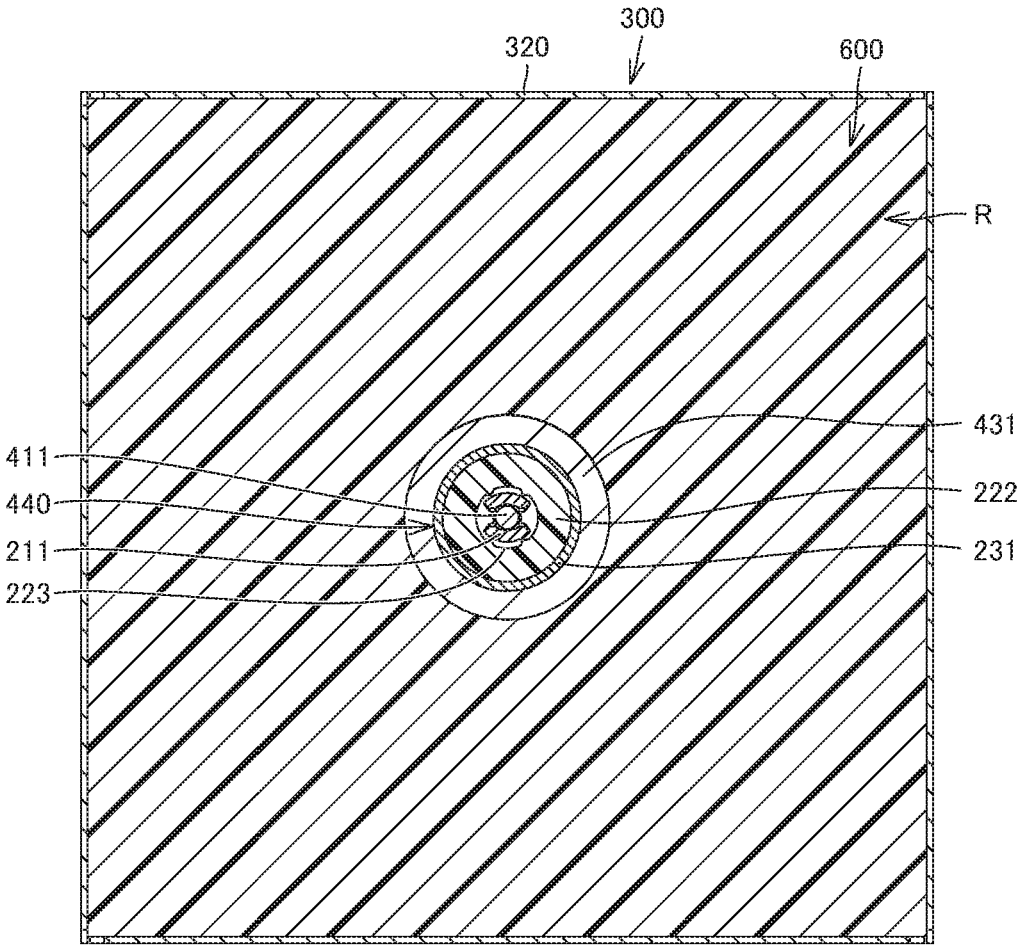
FIG. 2C is a cross-sectional view of the connection module, taken along line 2C-2C in FIG. 2A.
Figure 3A:
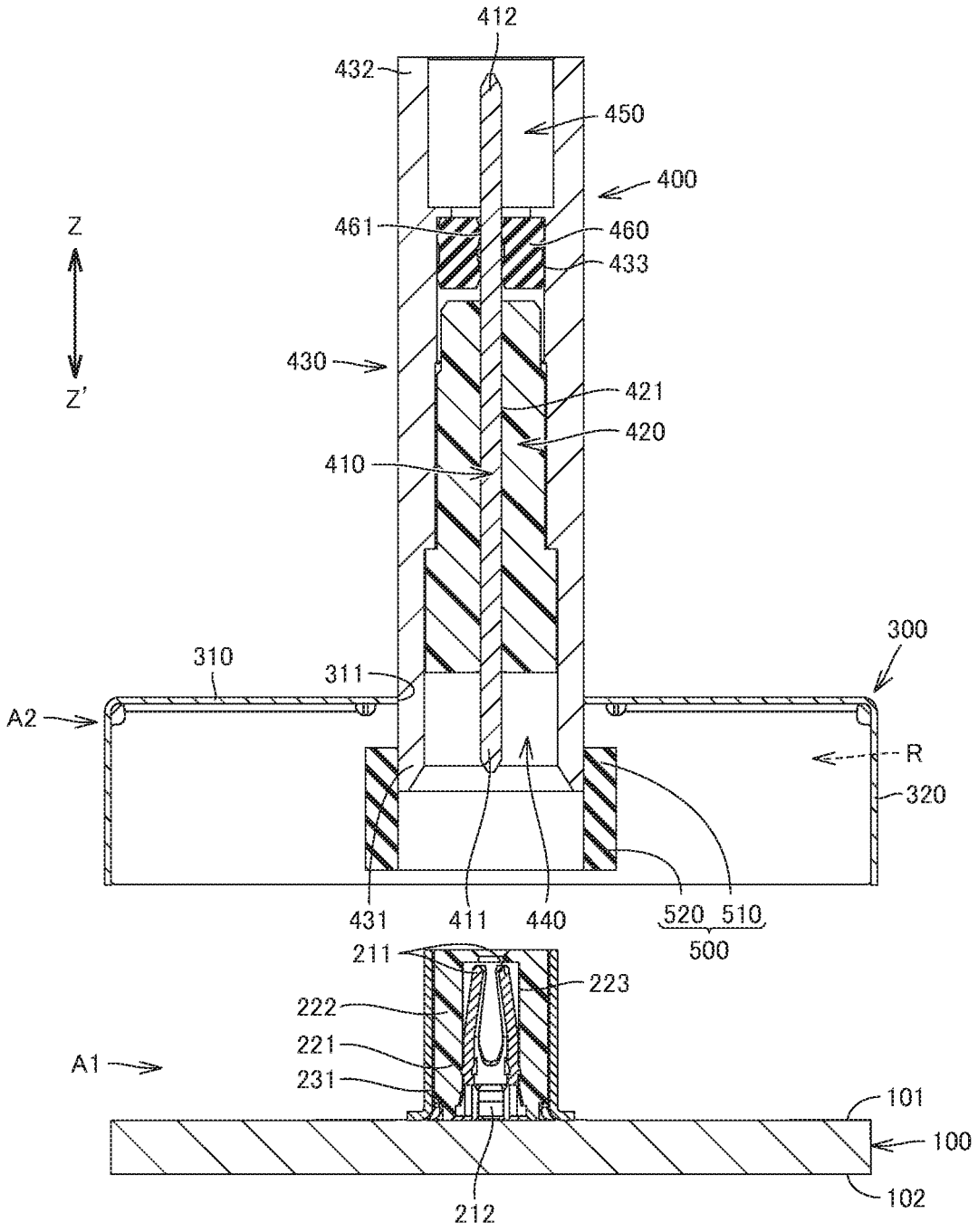
FIG. 3A is a cross-sectional view, taken along line 2A-2A in FIG. 1, of the connection module in a state before combining first and second connector assemblies of the connection module.
Figure 3B:
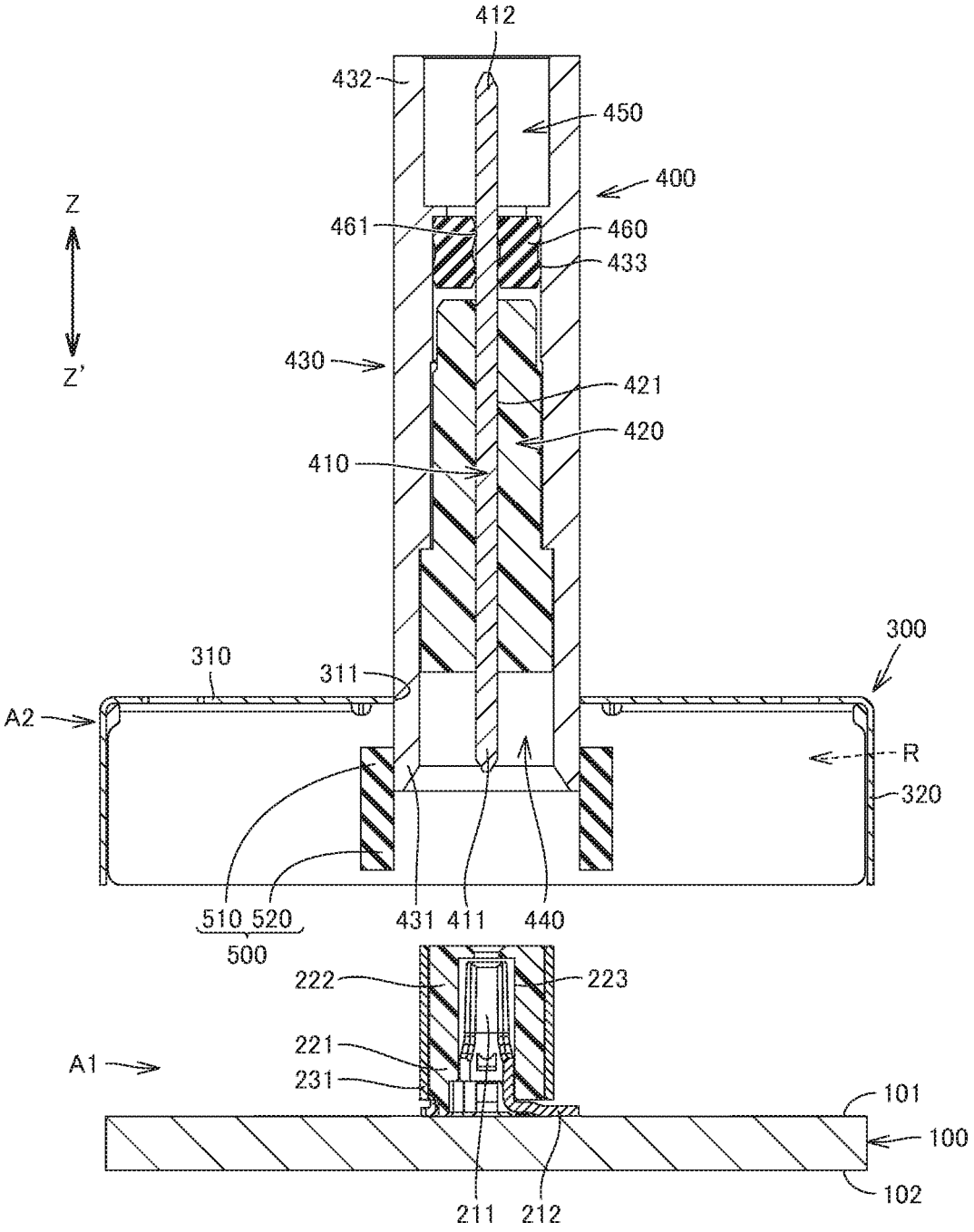
FIG. 3B is a cross-sectional view, taken along line 2B-2B in FIG. 1, of the connection module in a state before combining first and second connector assemblies of the connection module.

Various embodiments of the invention will now be described.

First Embodiment

A connection module M1 (or simply as a module M1) according to various embodiments of the invention including a first embodiment will now be described, with reference to FIG. 1 to FIG. 4B. FIG. 1 to FIG. 4B illustrate the module M1 according to the first embodiment.

The module M1 includes a first connector assembly A1 (or simply referred to as an assembly A1) and a second connector assembly A2 (or simply referred to as an assembly A2). It should be noted that the assembly A2 corresponds to the connector assembly defined in claim 1 and its dependent claims in the appended claims. The Z-Z' direction, indicated in FIGS. 2A, 2B, 3A and 3B, corresponds to a first direction in the claims.

The assembly A1 includes a circuit board 100 and a first connector 200. The Z-Z' direction is substantially perpendicular to the circuit board 100. The Z-Z' direction includes a Z direction and a Z' direction. The Z direction corresponds to "one side in the first direction" in the claims. The Z' direction corresponds to "the other side in the first direction" in the claims.

The circuit board 100 has a first face 101 on the Z-direction side and a second face 102 on the Z'-direction side. The circuit board 100 further includes at least one first electrode 110. The or each first electrode 110 may be a surface electrode provided on the first face 101 (see FIG. 4A) or may be a through-hole via electrode formed in the circuit board 100.

The first connector 200 is a male connector mounted on the first face 101 of the circuit board 100. The first connector 200 includes at least one terminal 210 and a body 220. The body 220 may be any type of body which is formed of insulating resin and configured to hold the at least one terminal 210. For example, the body 220 may include at least one housing portion 223, which or each of which is a hole or groove for holding at least part of the or a corresponding terminal 210. In the embodiment of FIG. 2A to FIG. 4B, the body 220 includes a single housing portion 223, which is a hole opening in the Z and Z' directions and holding a single terminal 210. In another aspect, the at least one terminal 210 may be embedded in the body 220 by insert molding or other means. The body 220 includes a base 221 provided on the Z'-direction side and a distal portion 222 extending in the Z direction from the base 221.

The or each terminal 210 includes a contact portion 211 and a tail 212. The contact portion 211 of the or each terminal 210 may be housed in the corresponding housing portion 223 of the body 220 as illustrated in FIGS. 2A to 3B. The or each contact portion 211 may be bifurcated as shown in FIG. 2A to FIG. 4B, or may have a rod shape, a tuboid shape, a U-shaped cross-section in a direction orthogonal to the Z-Z' direction, or other shape. In another aspect, the contact portion 211 of the at least one terminal 210 may be exposed or may protrude from the distal portion 222 of the body 220. In this case, the or each contact portion 211 may have a flat-plate shape or a rod shape. The tail 212 of the or each terminal 210 is electrically and mechanically connected to the or a respective corresponding first electrode 110 of the circuit board 100, with solder, conductive adhesive, or the like material. Of note, where a plurality of terminals 210 is provided, it is desirable to provide a corresponding number of first electrodes 110. Also, the body 223 may optionally be provided with a plurality of housing portions 223 in accordance with the number of terminals 210.

Figure 4A:
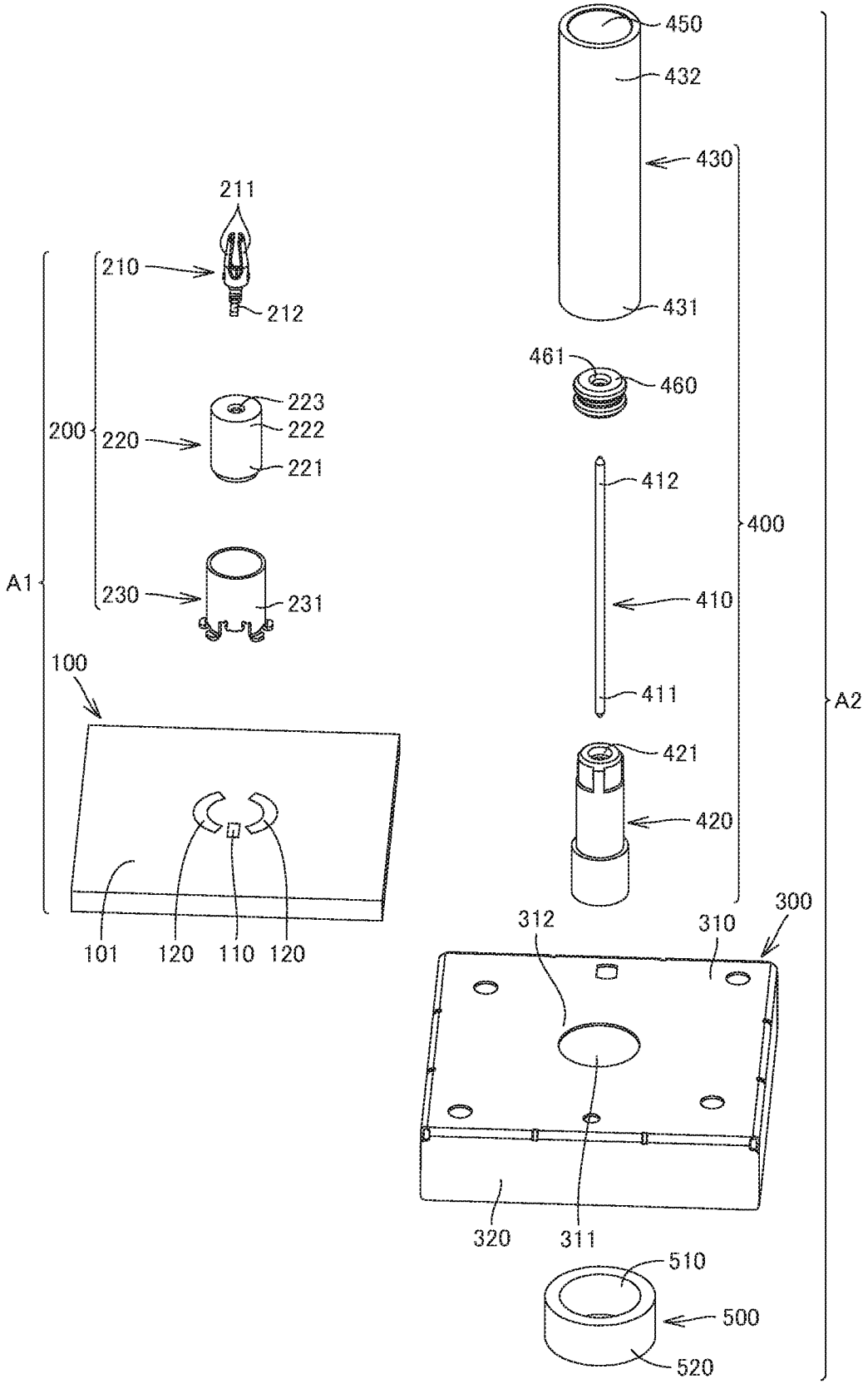
FIG. 4A is an exploded, rear top left side perspective view of the connection module.
Figure 4B:
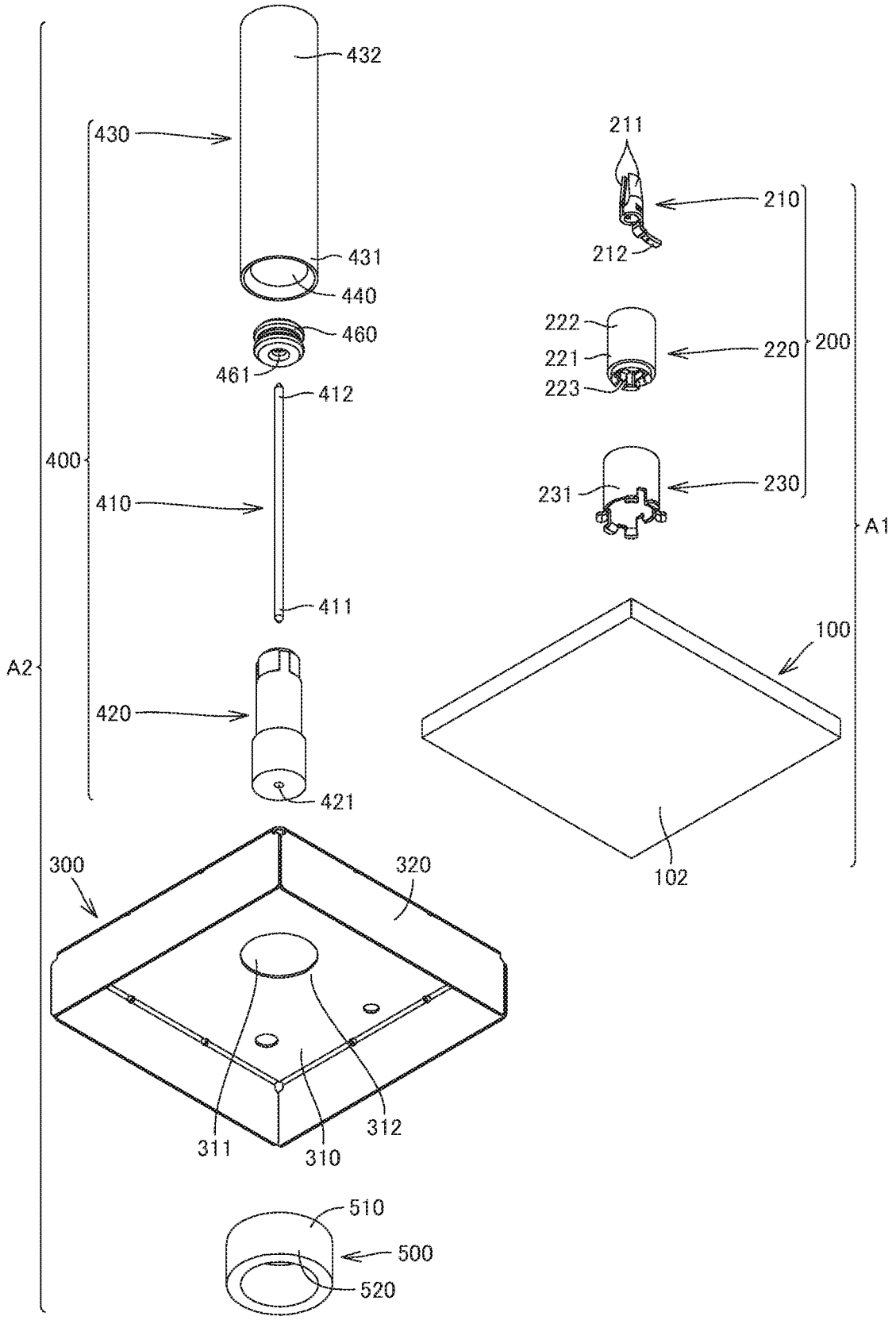
FIG. 4B is an exploded, front bottom right side perspective view of the connection module.
Figure 5A:
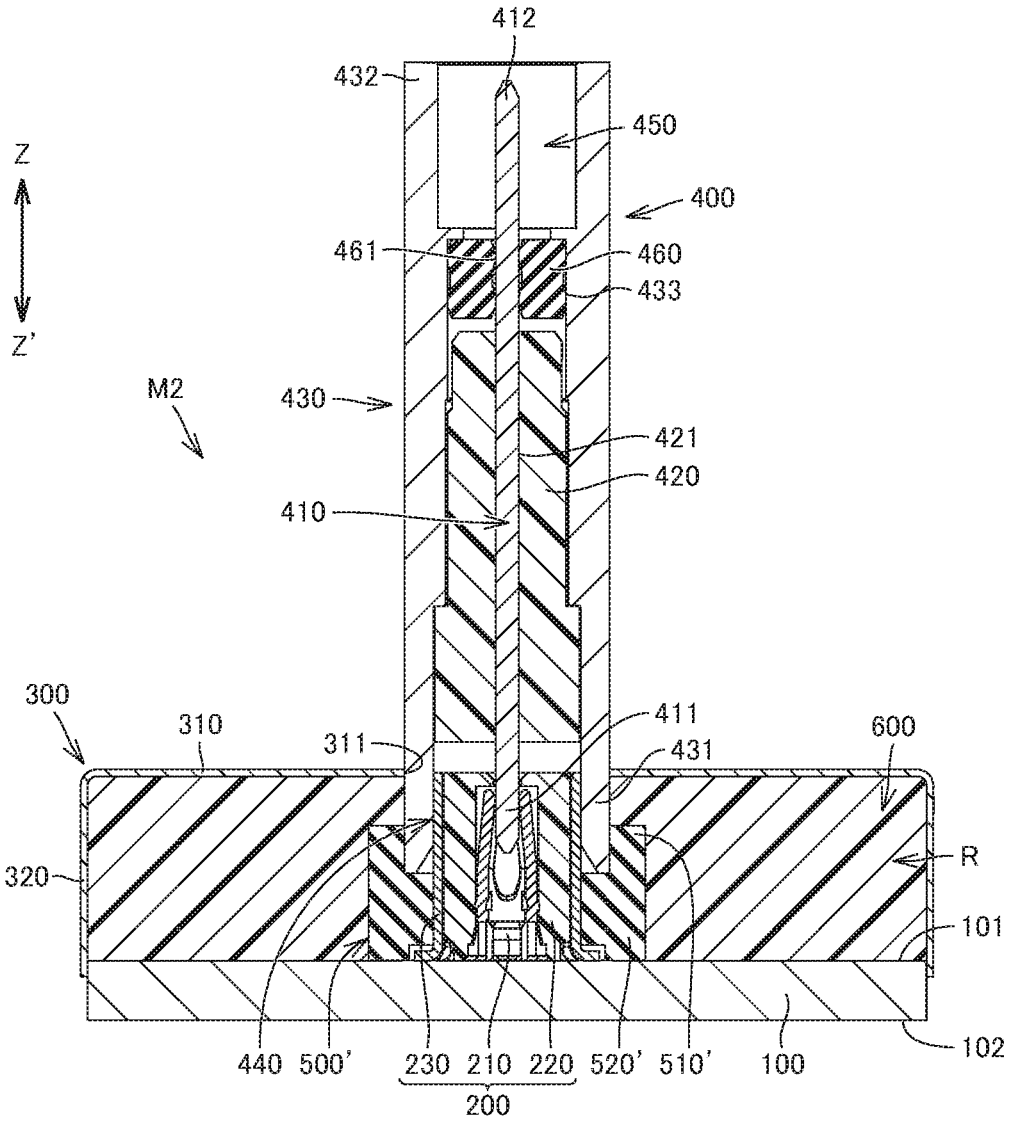
FIG. 5A is a cross-sectional view of a connection module according to a second embodiment of the invention, corresponding to FIG. 2A.
Figure 5B:
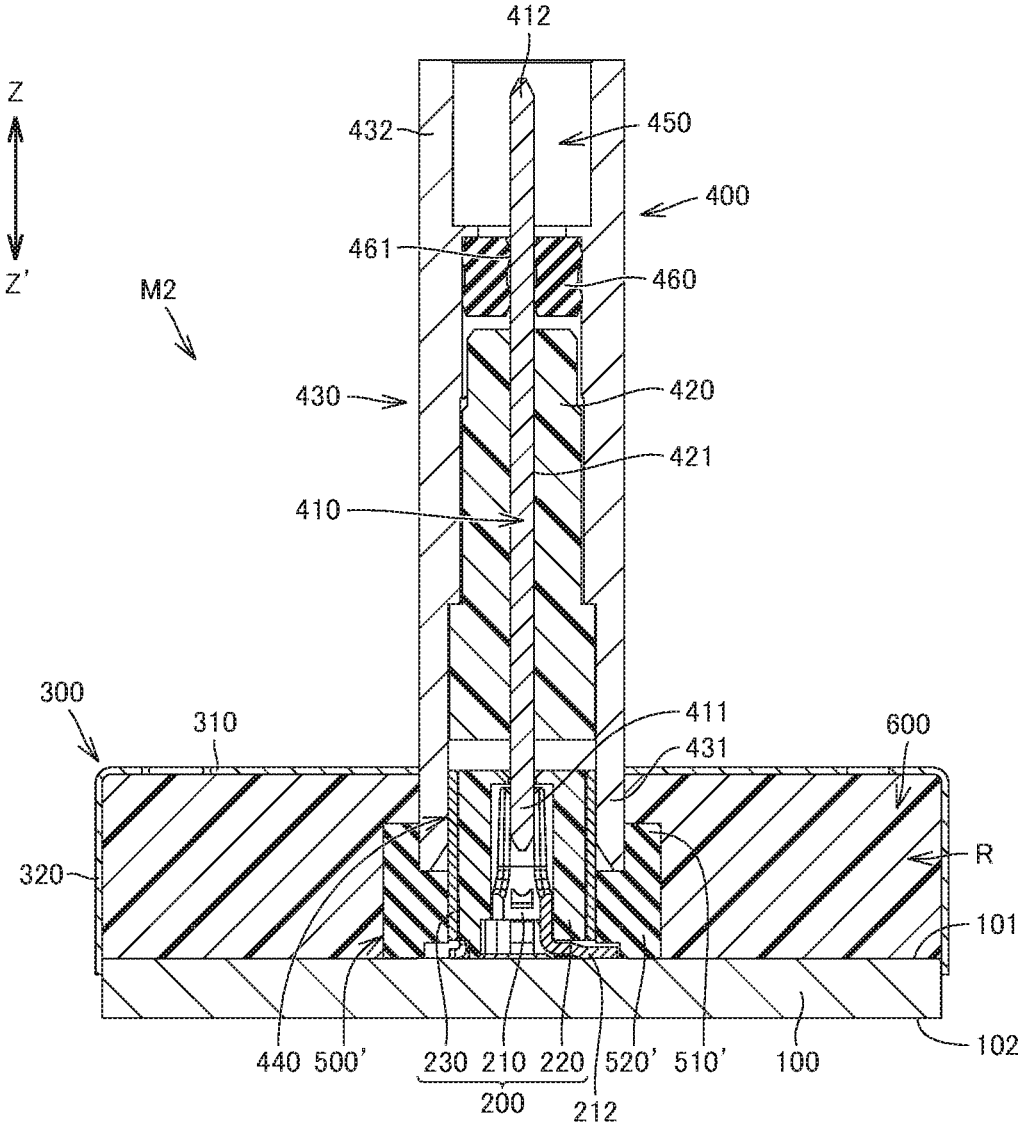
FIG. 5B is a cross-sectional view of the connection module, corresponding to FIG. 2B.
Figure 6A:
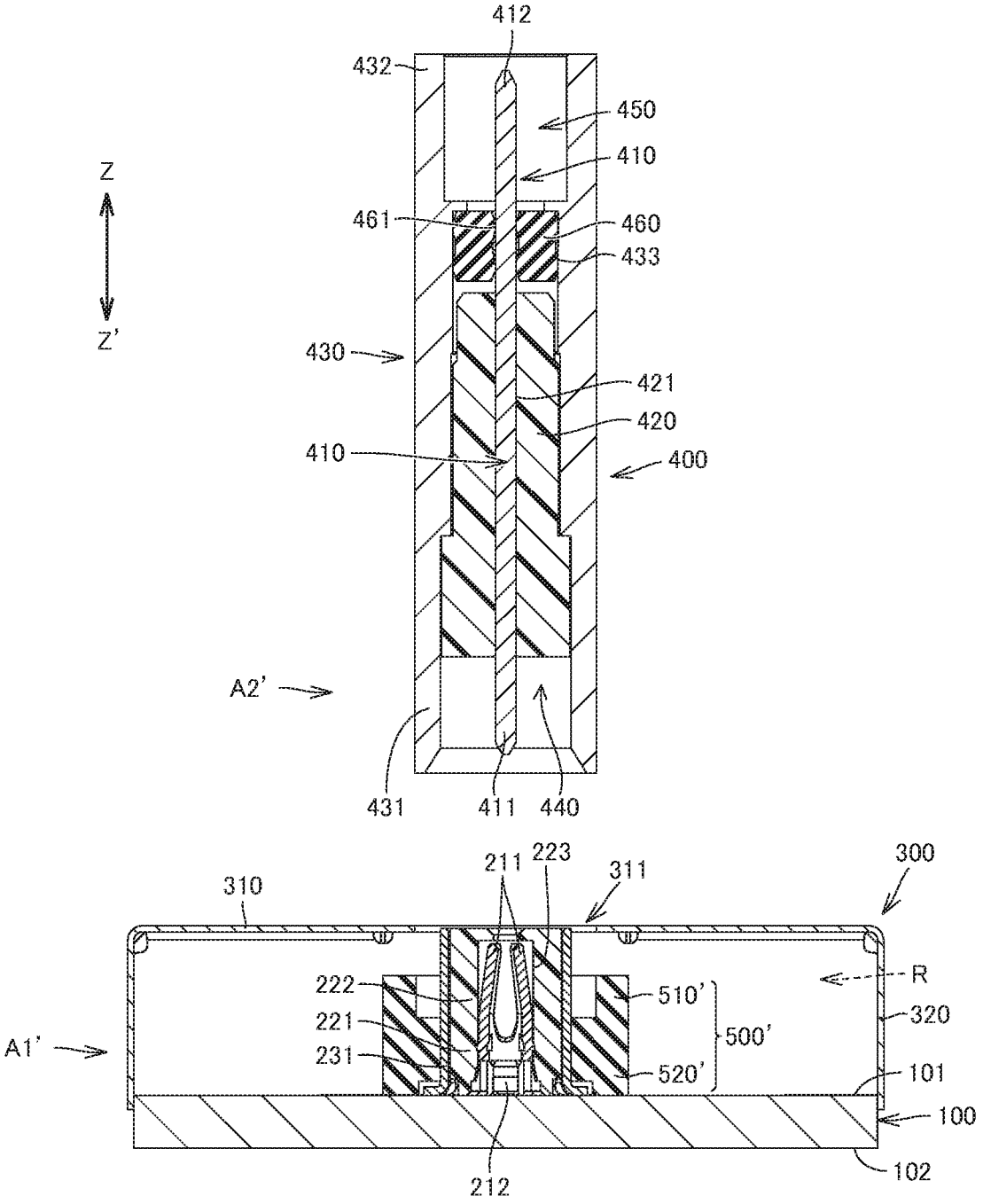
FIG. 6A is an exploded cross-sectional view of the connection module in a state before injecting thermal-conductive resin, corresponding to FIG. 3A.
Figure 6B:
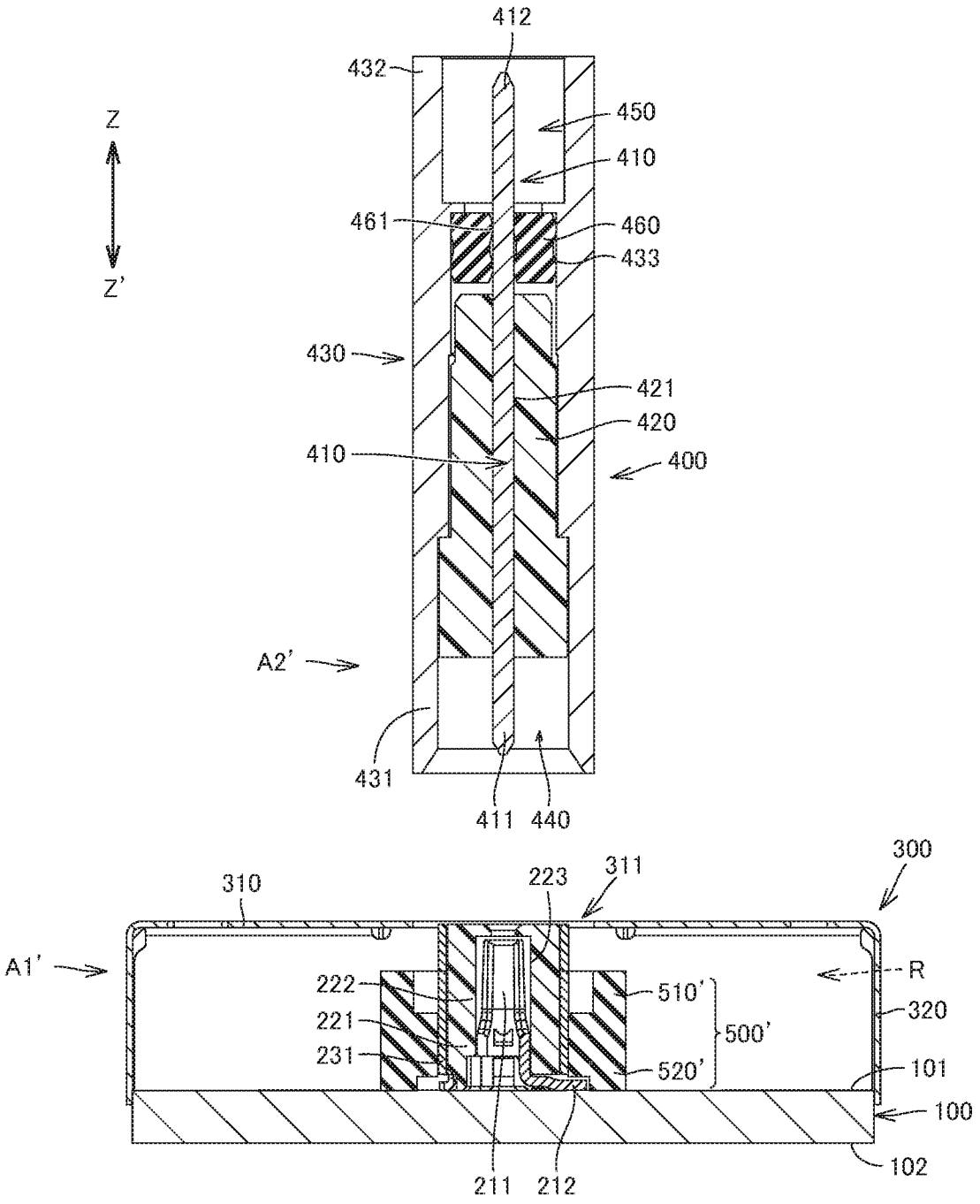
FIG. 6B is an exploded cross-sectional view of the connection module in a state before injecting thermal-conductive resin, corresponding to FIG. 3B.

The first connector 200 may further include a shell 230 of an electrically conductive material. If the shell 230 is provided, the circuit board 100 further includes at least one second electrode 120. The or each second electrode 120 may also be a surface electrode provided on the first face 101 or may be a through-hole via electrode formed in the circuit board 100. The shell 230 is electrically and mechanically connected to the at least one second electrode 120 with solder, conductive adhesive, or the like material. In the embodiment of FIG. 4A, two second electrodes 120 are provided, which are surface electrodes.

The shell 230 is optional, and if provided, the shell 230 has a tube 231. The tube 231 has an inner shape corresponding to the outer shape of the body 220 and has inner dimensions that are substantially the same as, or slightly smaller than, outer dimensions of the tube 231 of the body 220. Accordingly, the body 220 fits in the tube 231. The dimension in the Z-Z' direction of the tube 231 may be substantially the same as that of the body 220 as illustrated in FIG. 2A to FIG. 3B. Alternatively, the dimension in the Z-Z' direction of the tube 231 may be smaller than that of the body 220, in which case it is only the base 221 of the body 220 that fits in the tube 231.

The assembly A2 includes a case 300 and a second connector 400. As illustrated in FIG. 1 to FIG. 4, the case 300 has a shape of a box with an open part, i.e. opening in the Z' direction. The case 300 may be made of a metal plate, or plastic material or the like. The case 300 is combinable with the circuit board 100 in the Z-Z' direction. More specifically, the case 300 can be combined with the circuit board 100 such that the circuit board 100 closes the open part of the case 300. The case 300 and the circuit board 100 as combined define an accommodation space R. The case 300 includes a top plate 310, which faces the circuit board 100 in the Z-Z' direction, and a side plate 320 of tuboid shape, which extends from the top plate 310 to abut the circuit board 100. The second connector 400 passes through the top plate 310 in the Z-Z' direction.

The case 300 may be provided separately from the second connector 400. In this case, the top plate 310 has an opening 311 extending through the top plate 310 in the Z-Z' direction. The second connector 400 passes through the opening 311, and an edge 312 of the opening 311 of the top plate 310 is attached to a Z-direction-side portion of a wall 431 (to be described) of the second connector 400.

Alternatively, the case 300 may be integrated with the second connector 400. In this case, the case 300 is integrated with the Z-direction-side portion of the wall 431 (to be described) of the second connector 400 by insert molding, double injection molding, or other method, so that the second connector 400 passes through the top plate 310 in the Z-Z' direction. In this case, the case 300 is formed by molding a plastic material.

The second connector 400 is a female connector, which passes through the top plate 310 of the case 300 in the Z-Z' direction and is connectable to the first connector 200 within the accommodation space R.

The second connector 400 includes at least one terminal 410 and a body 420. The body 420 is any type of body which is formed of insulating resin and configured to hold the at least one terminal 410. For example, the body 420 may include at least one housing portion 421, which or each of which is a hole or a groove for holding the or a corresponding terminal 410. In the embodiment of FIG. 2A to FIG. 4B, the body 420 includes a single housing portion 421, which is a through hole extending in the Z-Z' direction through the body 220, and the housing portion 421 holds a single terminal 410. In another aspect, the at least one terminal 410 may be embedded in the body 420 by insert molding or other means.

The second connector 400 may further includes a shell 430 of an electrically conductive material. The shell 430 is a generally tuboid body to accommodate and hold the body 420 therein. The shell 430 has a dimension in the Z-Z' direction that is larger than that of the body 420. The shell 430 has the wall 431 mentioned above. The wall 431 is a tuboid wall opening in the Z' direction. The wall 431 is positioned on the Z'-direction side relative to the body 420 of the shell 430. The wall 431 is positioned on the Z'-direction side relative to the top plate 310 of the case 300, and is disposed within the accommodation space R. The space inside the wall 431 serves as a connection hole 440 of the second connector 400 to receive, or fittingly receive, the first connector 200 in the Z-Z' direction. For the convenience of description, a state where the first connector 200 is received or fittingly received in the connection hole 440 of the second connector 400 will be referred to as a "connected state".

If the shell 430 is provided, the shell 430 further includes a wall 432. The wall 432 is a tuboid wall opening in the Z direction. The wall 432 is positioned on the Z-direction side relative to the body 420 of the shell 430. The space inside the wall 432 serves as a receiving hole 450 to receive an end portion of a cable (not shown).

The or each terminal 410 includes a contact portion 411 and a tail 412. In an aspect, the contact portion 411 of the or each terminal 410 protrudes in the Z' direction from the body 420 and is disposed in the connection hole 440. In this aspect, in the connected state, the contact portion 411 of the or each terminal 410 is in contact with the contact portion 211 of the corresponding terminal 210 in the housing portion 223 of the first connector 200. In another aspect, the contact portion 411 of the or each terminal 410 is exposed or protrudes from the body 420 and is disposed inside the connection hole 440. In this aspect, in the connected state, the contact portion 411 of the or each terminal 410 is in contact with the contact portion 211 of the corresponding terminal 210 being exposed or protruding from the distal portion 222 of the body 220 of the first connector 200.

The tail 412 of the at least one terminal 410 protrudes in the Z direction from the body 420 and is disposed in the receiving hole 450. The tail 412 of the or each terminal 410 is connected to the corresponding core of the cable (not shown).

The second connector 400 may further include an internal seal 460, which may be made of an elastic material, such as silicone rubber. If the internal seal 460 is provided, a portion on the Z'-direction side of the receiving hole 450 of the shell 430 may serve as a housing room 433. The internal seal 460 has outer dimensions slightly larger than the dimensions of the housing room 433. As such, in the state where the internal seal 460 as housed in the housing room 433, the outer circumferential face of the internal seal 460 is in intimate contact with the wall surface of the housing room 433. The internal seal 460 is provided with at least one through-hole 461 extending in the Z-Z' direction through the internal seal 460. The or each through-hole 461 has inner dimensions slightly smaller than the outer dimensions of a portion (hereinafter referred to as a "close-contact portion") of the corresponding terminal 410 that is positioned on the Z'-direction side relative the tail 412. As such, the or each inner circumferential face of the internal seal 460 (i.e. the circumferential wall of the or each through-hole 461) is in intimate contact with the close-contact portion of the corresponding terminal 410.

Of note, where a plurality of terminals 210 is provided, it is desirable to provide a corresponding number of terminals 410 and a corresponding number of cores of the cable. Also, the body 420 may optionally be provided with a plurality of housing portions 421 in accordance with the number of terminals 410. Where the second connector 400 includes the internal seal 460, the internal seal 460 may have a plurality of housing portions 421 in accordance with the number of terminals 410. As noted above, the internal seal 460 and the housing room 433 are optional.

Where the shell 430 is omitted, it is preferable that the connection hole 440 be provided at an end on the Z'-direction side of the body 220, the wall 431 be the tuboid wall around (defining) the connection hole 440, the receiving hole 450 be provided at an end portion on the Z-direction side of the body 220, and the wall 432 be the tuboid wall around (defining) the receiving hole 450. Where the second connector 400 includes the internal seal 460 with the shell 430 omitted, it is preferable that the housing room 433 be provided in a portion of the body 220 that is on the Z'-direction side relative to the receiving hole 450.

The assembly A2 further includes a sealing member 500 having a tuboid shape extending in the Z-Z' direction. The sealing member 500 has a dimension in the Z-Z' direction that is smaller than, or substantially the same as, the dimension in the Z-Z' direction from the first face 101 of the circuit board 100 to the top plate 310, and that is larger than the dimension in the Z-Z' direction from the first face 101 of the circuit board 100 to the distal end in the Z' direction of the wall 431 of the second connector 400. The sealing member 500 includes a first portion 510 and a second portion 520, which are tuboid end portions on the Z and Z' sides, respectively, of the sealing member 500.

The sealing member 500 may be provided separately from the second connector 400. In this case, the sealing member 500 is made of an elastic material (such as silicone rubber or elastomer), a plastic material, or the like. The first portion 510 of the sealing member 500 has an inner shape corresponding to the outer shape of at least part (e.g. an end portion on the Z'-direction side) of the wall 431 of the second connector 400, and has inner dimensions that are substantially the same as, or slightly smaller than, the outer dimensions of the at least part (the end portion on the Z'-direction side) of the wall 431. The first portion 510 fits around the at least part of the wall 431, with the inner circumferential face of the first portion 510 in intimate contact with the outer circumferential face of the at least part of the wall 431. Obviously the first portion 510 may fit around the wall 431 such that the inner circumferential face of the first portion 510 is in intimate contact with the entire outer circumferential face of the wall 431.

The second portion 520 of the sealing member 500 is positioned on the Z'-direction side relative to the at least part of the wall 431. The second portion 520 has inner dimensions larger than the outer dimensions of the first connector 200. The second portion 520 is configured to abut the first face 101 of the circuit board 100 within the accommodation space R, and to cover and surround the first connector 200.

Where the first connector 200 does not include the shell 230, the second portion 520 contains the part (connecting part) connecting together the tail 212 of the at least one terminal 210 of the first connector 200 and the at least one first electrode 110 of the circuit board 100. Where the first connector 200 includes the shell 230, the second portion 520 contains the said connecting part as well as the part connecting together the shell 230 of the first connector 200 and the at least one second electrode 120 of the circuit board 100.

The sealing member 500 thus fits around the at least part of the wall 431 and abuts the circuit board 100 so as to be disposed between the top plate 310 of the case 300 and the circuit board 100 (i.e. within the accommodation space R).

Where the sealing member 500 is made of an elastic material, the second portion 520 of the sealing member 500 may have a dimension in the Z-Z' direction that is slightly larger than that from the first face 101 of the circuit board 100 to the Z'-direction end of the wall 431 of the second connector 400. In this case, the second portion 520 of the sealing member 500 is elastically abuttable against the first face 101 of the circuit board 100.

In another aspect, the sealing member 500 may be integrated with at least part (e.g. an end portion on the Z'-direction side) of the wall 431 of the second connector 400. More specifically, the sealing member 500 may be integrally molded on the outer circumferential face of the at least part of the wall 431 of the second connector 400 by insert molding, double injection molding, or other method. The first portion 510 is thus integrated with the at least part of the wall 431 to fit around the at least part of the wall 431 and extend along the outer circumferential face of the wall 431 of the second connector 400. Also, in this aspect, the second portion 520 is configured as described above. In this aspect, the sealing member 500 is formed by molding a plastic material to be molded integrally with the outer circumferential face of the wall 431, and to be disposed within the accommodation space R. The first portion 510 may be integrated with (integrally fixed to) the entire wall 431.

The said "at least part of the wall 431," around which the first portion 510 fits, corresponds to the "accommodatable portion" of the second connector recited in the claims. The expression "the first portion fits around the accommodatable portion of the second connector" in the present invention is not limited to a configuration that the first portion of the sealing member is provided as a separate member and fits around the accommodatable portion of the second connector, and also covers a configuration that the first portion of the sealing member is integrated with and fits around the accommodatable portion of the second connector.

The module M1 further includes thermal-conductive resin 600. The thermal-conductive resin 600 may have any thermal conductivity that is at least higher than that of air (0.0241 W/m·K). The accommodation space R can be filled with the thermal-conductive resin 600.

In connection with the module M1 described above, the following describes a method for manufacturing the assembly A1 of the module M1. The circuit board 100 and the first connector 200 are prepared. Where the first connector 200 includes the shell 230, the at least one terminal 210 of the first connector 200 is connected to the at least one first electrode 110 on or in the first face 101 of the circuit board 100 with solder, conductive adhesive, or the like material, and the shell 230 of the first connector 200 is connected to the at least one second electrode 120 of the first face 101 of the circuit board 100 with solder, conductive adhesive, or the like material. Where the first connector 200 does not include the shell 230, the at least one terminal 210 of the first connector 200 is connected to the at least one first electrode 110 of the first face 101 of the circuit board 100 with solder, conductive adhesive, or the like material. The first connector 200 is thus mounted on the first face 101 of the circuit board 100 to manufacture the assembly A1.

In connection with the module M1 described above, the following describes a first method for manufacturing the assembly A2 of the module M1. For the purpose of description and not of limitation, the assembly A2 here will be configured such that the second connector 400 is provided separately from the case 300 and the sealing member 500. The second connector 400 and the case 300 are prepared. The second connector 400 is inserted through the opening 311 of the top plate 310 of the case 300, and a portion on the Z-direction side of the wall 431 of the second connector 400 is attached to the edge 312 of the opening 311. The second connector 400 thus passes through the top plate 310 of the case 300 in the Z-Z' direction. The sealing member 500 is also prepared. At least part of the wall 431 of the second connector 400 is pushed into the first portion 510 of the sealing member 500. As a result, the first portion 510 of the sealing member 500 fits around the at least part of the wall 431 and is disposed on the Z'-direction side relative to the top plate 310 of the case 300. The assembly A2 is thus manufactured.

The following describes a second method for manufacturing the assembly A2 of the module M1 described above. For the purpose of description and not of limitation, the assembly A2 here will be configured such that the second connector 400 is integrated with the case 300 and the sealing member 500. The second connector 400 is placed into a first mold (not shown). Exposed in a cavity of the first mold is a portion of the second connector 400 that is positioned on the Z-direction side relative to the wall 431. The cavity has a shape corresponding to the shape of the case 300. Then molten plastic material is injected into the cavity of the first mold, and then cools and solidifies. As a result, the case 300 is molded, with its top plate 310 integrally molded on the portion of the second connector 400 that is positioned more on the Z-direction side relative to the wall 431, and with the second connector 400 passing through the top plate 310 in the Z-Z' direction.

The second connector 400 is placed into a second mold (not illustrated). Exposed in a cavity of the second mold is the outer circumferential face of at least part of the wall 431 of the second connector 400. The cavity has a shape corresponding to the shape of the sealing member 500. Then molten plastic material is injected into the cavity of the second mold, and then cools and solidifies. Thus, the sealing member 500 is molded integrally and securely with the at least part of the wall 431 of the second connector 400. This is a second method for fabricating the assembly A2.

Of note, it is possible to combine the above methods for manufacturing the assembly A2. Particularly, it is possible to manufacture the assembly A2 such that the case 300 is molded integrally with the second connector 400, and that the sealing member 500 is provided separately from the second connector 400 to fit around the wall 431 of the second connector 400. It is also possible to manufacture the assembly A2 such that the case 300 is provided separately from the second connector 400 to be inserted through the opening 311 of the case 300 and attached to the case 300, and that the sealing member 500 is molded integrally with the at least part of the wall 431 of the second connector 400.

The following describes a method for manufacturing the module M1 using the assembly A1 and the assembly A2. The assembly A1 and the assembly A2 are brought closer to each other in the Z-Z' direction and combined with each other, more particularly in the following manners (1) and (2).

(1) The circuit board 100 of the assembly A1 is combined with the case 300 of the assembly A2 such that the circuit board 100 closes the open part of the case 300, whereby the circuit board 100 and the case 300 define the accommodation space R.

(2) The first connector 200 of the assembly A1 is inserted into the sealing member 500 of the assembly A2, so that the first connector 200 is inserted into, or inserted fittingly into, the connection hole 440 of the second connector 400. The second portion 520 of the sealing member 500 is brought into abutment with the first face 101 of the circuit board 100 to cover and surround the first connector 200. In this step, the contact portion 211 of the or each terminal 210 of the first connector 200 is brought into contact with the contact portion 411 of the or each terminal 410 of the second connector 400, so that the first connector 200 is electrically connected to the second connector 400. Where the sealing member 500 is made of an elastic material, the second portion 520 of the sealing member 500 is brought into elastic abutment and intimate contact with the first face 101 of the circuit board 100.

Then, molten thermal-conductive resin is injected into and fill the accommodation space R. The injected thermal-conductive resin cools and solidifies to form the thermal-conductive resin 600.

Where the assembly A2 is configured such that the first portion 510 of the sealing member 500 fits around a part of the wall 431, the thermal-conductive resin 600 is in intimate contact with, therefore leaving no gap to, the circuit board 100, the top plate 310 of the case 300, the side plate 320 of the case 300, the sealing member 500, and the exposed portion of the wall 431 of the second connector 400. The exposed portion of the wall 431 is a portion of the wall 431 that is positioned within the accommodation space R and exposed from the sealing member 500.

Where the assembly A2 is configured such that the first portion 510 of the sealing member 500 fits around the entire outer circumferential face of the wall 431, the thermal-conductive resin 600 is in intimate contact with, therefore leaving no gap to, the circuit board 100, the top plate 310 of the case 300, the side plate 320 of the case 300, and the sealing member 500.

It should be noted that the invention is not limited to such configuration that there is no gap from the thermal-conductive resin 600 to each of the above referenced elements of the assemblies A1 and A2.

Thus, embedded into the thermal-conductive resin 600 are the first connector 200, the sealing member 500, and the wall 431 of the second connector 400. The module M1 is thus obtained.

The module M1 can be fabricated inside a casing of an electronic device, such as a camera module. In this case, before bringing the assembly A1 and the assembly A2 closer to each other, the circuit board 100 of the assembly A1 is mounted on a certain component inside the casing of the electronic device such that the circuit board 100 and the component are stacked along the Z-Z' direction. The circuit board 100 on the component may tilt relative to an imaginary plane extending perpendicularly to the Z-Z' direction, due to at least one of the following reasons.

(a) Where the circuit board 100 of the assembly A1 is set on a certain component inside the casing of the electronic device, the circuit board 100 may tilt due to a dimensional tolerance of the component on which the circuit board 100 is set and/or a dimensional tolerance of one or a plurality of other components of the electronic part on which the component is directly or indirectly set.

(b) Where the electronic device includes a floating mechanism, the circuit board 100 of the assembly A1 may tilt when mounting the circuit board 100 directly or indirectly on the floating mechanism inside the casing of the electronic device. If the circuit board 100 tilts due to the combination of reasons (a) and (b), the floating mechanism corresponds to the component or the other component(s) of the electronic device mentioned above.

Then, the assembly A2 is brought closer to the assembly A1 inside the casing of the electronic device in a manner as described above and combined with the assembly A1 in the above manner (1) through (2). Where the sealing member 500 is made of an elastic material, step (2) above includes bringing the second portion 520 of the sealing member 500 elastically against (pressing it against) the first face 101 of the circuit board 100. Then thermal-conductive resin is injected into the accommodation space R in a manner described above to form the thermal-conductive resin 600.

It should be appreciated that the tilt of the circuit board 100 may occur not only when the module M1 is fabricated inside the casing of the electronic device, but also due to other factors, such as due to a tilt of a part (outside the electronic device) to place the circuit board 100 on.

The assemblies A1 and A2 and the module M1 described above provide at least the following technical feature and effects. The assemblies A1 and A2 and the module M1 provide improved heat dissipation for the following reason. It is within the accommodation space R that the first portion 510 of the sealing member 500 fits around the at least part of the wall 431 of the second connector 400, and that the second portion 520 of the sealing member 500 abuts the circuit board 100 and covers the first connector 200. This arrangement makes it possible to fill the accommodation space R with the thermal-conductive resin 600 by injecting thermal-conductive resin into the accommodation space R because the injected thermal-conductive resin will not enter the inside of the sealing member 500 (i.e. the inside of the first and the second connectors 200 and 400). The thermal-conductive resin 600 allows dissipation of heat from the circuit board 100 and the first and the second connectors 200 and 400 to the outside of the case 300.

Where the sealing member 500 of the module M1 is made of an elastic material, when connecting together the first connector 200 and the second connector 400, the second portion 520 of the sealing member 500 is brought into elastic abutment with (pressed against) the first face 101 of the circuit board 100. This arrangement reduces the possibility that a gap is left between the sealing member 500 and the first face 101 of the circuit board 100. This makes it further difficult for thermal-conductive resin filled in the accommodation space R to enter the inside of the sealing member 500.

In particular, when the circuit board 100 tilts due to any of the above reasons, the tilt can be absorbed by the elastic abutment of the sealing member 500. Therefore, it is unlikely that a gap is left between the sealing member 500 and the first face 101 of the circuit board 100.

Second Embodiment

A connection module M2 (or simply as a module M2) according to various embodiments of the invention including a second embodiment will now be described, with reference to FIG. 5A to FIG. 6B. FIG. 5A to FIG. 6B illustrate the module M2 according to the second embodiment. The connection module M2 includes a first connector assembly A1' (or simply referred to as an assembly A1') and a second connector assembly A2' (or simply referred to as an assembly A2').

The module M2 has a similar configuration to the module M1 but is different from the module M1 in the respects 1 and 2 below. The module M2 will be described focusing on the differences and omitting overlapping descriptions.

Difference 1: It is the assembly A1', not the assembly A2', that includes a sealing member 500'. More particularly, the sealing member 500' fits around the Z'-direction side portion of the first connector 200 of the assembly A1', rather than fitting around the at least part of the wall 431 of the second connector 400 of the assembly A2'.

Difference 2: It is the assembly A1', not the assembly A2', that includes the case 300. Accordingly, the assembly A2' of the module M2 does not include the case 300 nor the sealing member 500.

The assembly A1' corresponds to the connector assembly defined in claim 4 and its dependent claims in the appended claims. The Z-Z' direction is indicated in FIG. 5A to FIG. 6B, in a similar manner to FIGS. 2A, 2B, 3A and 3B.

The case 300 is combined with the circuit board 100 such that the circuit board 100 closes the open part of the case 300.

The sealing member 500' includes a first portion 510' and a second portion 520', which are tuboid end portions on the Z and Z' sides, respectively, of the sealing member 500.

The sealing member 500' may be provided separately from the first connector 200. In this case, the second portion 520' has an inner shape corresponding to the outer shape of at least part of the first connector 200 and has inner dimensions that are substantially the same as, or slightly smaller than, the outer dimensions of the at least part of the first connector 200. The second portion 520' of the sealing member 500' fits around the at least part of the first connector 200, with the inner circumferential face of the second portion 520' in intimate contact with the outer circumferential face of the at least part of the first connector 200. The second portion 520' also abuts the first face 101 of the circuit board 100. The second portion 520' covers the first connector 200.

Where the first connector 200 does not include the shell 230, the second portion 520' contains the part (connecting part) connecting together the tail 212 of the at least one terminal 210 of the first connector 200 and the at least one first electrode 110 of the circuit board 100. Where the first connector 200 includes the shell 230, the second portion 520' contains the said connecting part as well as the part connecting together the shell 230 of the first connector 200 and the at least one second electrode 120 of the circuit board 100.

The above at least part of the first connector 200 may be a portion on the Z'-direction side (e.g. the tuboid portion 231) of the shell 230 where the first connector 200 includes the shell 230. The at least part of the first connector may be a portion on the Z'-direction side (e.g. the base 221) of the body 220 of the first connector 200 where the first connector 200 does not include the shell 230.

Where the sealing member 500' is provided separately from the first connector 200, the first portion 510' of the sealing member 500' has an inner shape corresponding to the outer shape of the at least part (e.g. the portion on the Z'-direction side) of the wall 431 of the second connector 400. The first portion 510' has inner dimensions that are substantially the same as, or slightly smaller than, the outer dimensions of the at least part of the wall 431. The inner dimensions of the first portion 510' are larger than those of the second portion 520'. Accordingly, the first portion 510' can fit around the at least part of the wall 431.

Where the sealing member 500' is made of an elastic material, the first portion 510' of the sealing member 500' may have inner dimensions that are slightly smaller than the outer dimensions of the at least part of the wall 431. In this case, the first portion 510' more tightly fits around the at least part of the wall 431.

In another aspect, the sealing member 500' may be integrated with the at least part of the first connector 200. More specifically, the sealing member 500' may be integrally molded on the outer circumferential face of the at least part of the first connector 200 by insert molding, double injection molding, or other method. The second portion 520' is thus integrated with the at least part of the first connector 200 to fit around the at least part of the first connector 200. The second portion 520' extends along the outer circumferential face of the at least part of the first connector 200. Also in this aspect, the first portion 510' is configured as described above. In this aspect, the sealing member 500' is formed by molding a plastic material to be molded integrally with the outer circumferential face of the at least part of the first connector 200.

The expression "the second portion fits around at least part of the first connector" in the present invention is not limited to a configuration that the second portion of the sealing member is provided as a separate member and fits around the at least part of the first connector, and also covers a configuration that the second portion of the sealing member is integrated with and fits around the first connector.

The following describes a method for manufacturing the assembly A1'. For the purpose of description and not of limitation, the assembly A1' here will be configured such that the sealing member 500' is provided separately from the first connector 200. As in the method for manufacturing the assembly A1, the first connector 200 is mounted on the first face 101 of the circuit board 100. The sealing member 500' is prepared, separately from the first connector 200. The at least part of the first connector 200 is pushed into the second portion 520' of the sealing member 500'. As a result, the second portion 520' of the sealing member 500' fits around the at least part of the first connector 200 such that the inner circumferential face of the second portion 520' is in intimate contact with the outer circumferential face of the at least part of the first connector 200, and the second portion 520' abuts the first face 101 of the circuit board 100. As a variant of this manufacturing method, the sealing member 500' may be placed to fit around the at least part of the first connector 200 before mounting the first connector 200 on the circuit board 100. In this case, when the first connector 200 is mounted on the first face 101 of the circuit board 100, the second portion 520' abuts the first face 101 of the circuit board 100.

Where the sealing member 500' is made of an elastic material, the second portion 520' of the sealing member 500' is brought into elastically abutment and intimate contact with the first face 101 of the circuit board 100.

Where the assembly A1' will be configured such that the sealing member 500' is integrated with the at least part of the first connector 200, the fitting step of the sealing member 500' should be modified as follows. The first connector 200 is placed into a mold (not illustrated). Exposed in a cavity of the mold is the at least part of the first connector 200. The cavity has a shape corresponding to the shape of the sealing member 500'. Then molten plastic material is injected into the cavity of the mold, and then cools and solidifies. Thus, the sealing member 500' is molded integrally and securely with the at least part of the first connector 200.

After the first connector 200 is mounted on the circuit board 100, and after the sealing member 500' is brought into abutment with the first face 101 of the circuit board 100, the case 300 is prepared. The circuit board 100 and the case 300 are combined together such that the circuit board 100 closes the open part of the case 300. As a result, the circuit board 100 and the case 300 define the accommodation space R. The assembly A1' is thus manufactured.

The assembly A2' is manufactured by a method similar to the first or second method for manufacturing the assembly A2, without including the step of fitting or molding the sealing member 500 around the second connector 400 nor the step of attaching the case 300 to the second connector 400 or molding the case 300 over the second connector 400.

The following describes a method for manufacturing the module M2 using the assembly A1' and the assembly A2'. The assembly A1' and the assembly A2' are brought closer to each other in the Z-Z' direction and combined with each other, more particularly in the following manners.

The wall 431 of the second connector 400 of the assembly A2' is inserted into the opening 311 of the case 300 of the assembly A1', the at least part of the wall 431 is pushed into the sealing member 500' of the assembly A1', and the first portion 510' of the sealing member 500' is placed to fit around the at least part of the wall 431 and to be in intimate contact with the outer circumferential face of at least part of the wall 431. Also, the first connector 200 of the assembly A1' is inserted into, or inserted fittingly into, the connection hole 440 of the second connector 400 of the assembly A2'. In this step, the contact portion 211 of the or each terminal 210 of the first connector 200 is brought into contact with the contact portion 411 of the or each terminal 410 of the second connector 400, so that the first connector 200 is electrically connected to the second connector 400. Where the sealing member 500' is made of an elastic material, the first portion 510' of the sealing member 500' is brought into elastic abutment and intimate contact with the at least part of the outer circumferential face of the wall 431.

The module M2 can also be fabricated inside a casing of an electronic device, such as a camera module. Where the sealing member 500' is made of an elastic material, in the step of fitting the first portion 510' of the sealing member 500' around the at least part of the wall 431, the second portion 520' of the sealing member 500' is brought into elastic abutment with (pressed against) the first face 101 of the circuit board 100.

Then, molten thermal-conductive resin is injected into and fill the accommodation space R. The injected thermal-conductive resin cools and solidifies to form the thermal-conductive resin 600, with the first connector 200, the sealing member 500', and the wall 431 of the second connector 400 embedded therein. The module M2 is thus obtained.

The assemblies A1' and A2' and the module M2 described above provides at least the following technical feature and effects. The assemblies A1' and A2' and the module M2 provides improved heat dissipation for the following reason. It is within the accommodation space R that the second portion 520' of the sealing member 500' fits around the at least part of the first connector 200 and abuts the circuit board 100, and the first portion 510' of the sealing member 500' fits around the at least part of the wall 431 of the second connector 400. This arrangement makes it possible to fill the accommodation space R with the thermal-conductive resin 600 by injecting thermal-conductive resin into the accommodation space R because the injected thermal-conductive resin will not enter the inside of the sealing member 500 (i.e. the inside of the first and the second connectors 200 and 400). The thermal-conductive resin 600 allows dissipation of heat from the circuit board 100 and the first and the second connectors 200 and 400 to the outside of the case 300.

Where the sealing member 500' of the module M2 is made of an elastic material, the second portion 520' of the sealing member 500' is brought into elastic abutment with (pressed against) the first face 101 of the circuit board 100. This arrangement reduces the possibility that a gap is left between the sealing member 500' and the first face 101 of the circuit board 100. This makes it difficult for thermal-conductive resin filled in the accommodation space R to enter the inside of the sealing member 500'.

In particular, when the circuit board 100 tilts due to any of the above reasons, the tilt can be absorbed by the elastic abutment of the sealing member 500'. Therefore, it is unlikely that a gap is left between the sealing member 500' and the first face 101 of the circuit board 100.

It should be appreciated that the connector assemblies, the connection modules, and the methods for manufacturing the connector assemblies and the connection modules are not limited to the embodiments described above but may be modified in any manner within the scope of the claims. Specific modification examples will be described below.

The case 300 may be omitted from the assembly A1'. In this case, the assembly A2' may include the case 300 of any of the aspects of the assembly A2. The assembly A1' with the case 300 omitted corresponds to a connector assembly defined in claim 3 and its dependent claims in the appended claims. A connection module including the assembly A1' and the assembly A2' thus modified may be manufactured in the following manner. The assembly A1' and the assembly A2' are brought closer to each other in the Z-Z' direction and combined together. As a result, the circuit board 100 of the assembly A1' and the case 300 of the assembly A2' are combined such that the circuit board 100 closes the open part of the case 300, whereby the circuit board 100 and the case 300 defines the accommodation space R. Also, the at least part of the wall 431 of the second connector 400 of the assembly A2' is pushed into the sealing member 500' of the assembly A1', and the first portion 510' of the sealing member 500' fits around the at least part of the wall 431 to be in intimate contact with the outer circumferential face of the at least part of the wall 431. Furthermore, the first connector 200 of the assembly A1' is inserted into, or inserted fittingly into, the connection hole 440 of the second connector 400. In this step, the contact portion 211 of the or each terminal 210 of the first connector 200 is brought into contact with the contact portion 411 of the or each terminal 410 of the second connector 400, so that the first connector 200 is electrically connected to the second connector 400.

Figure 7:
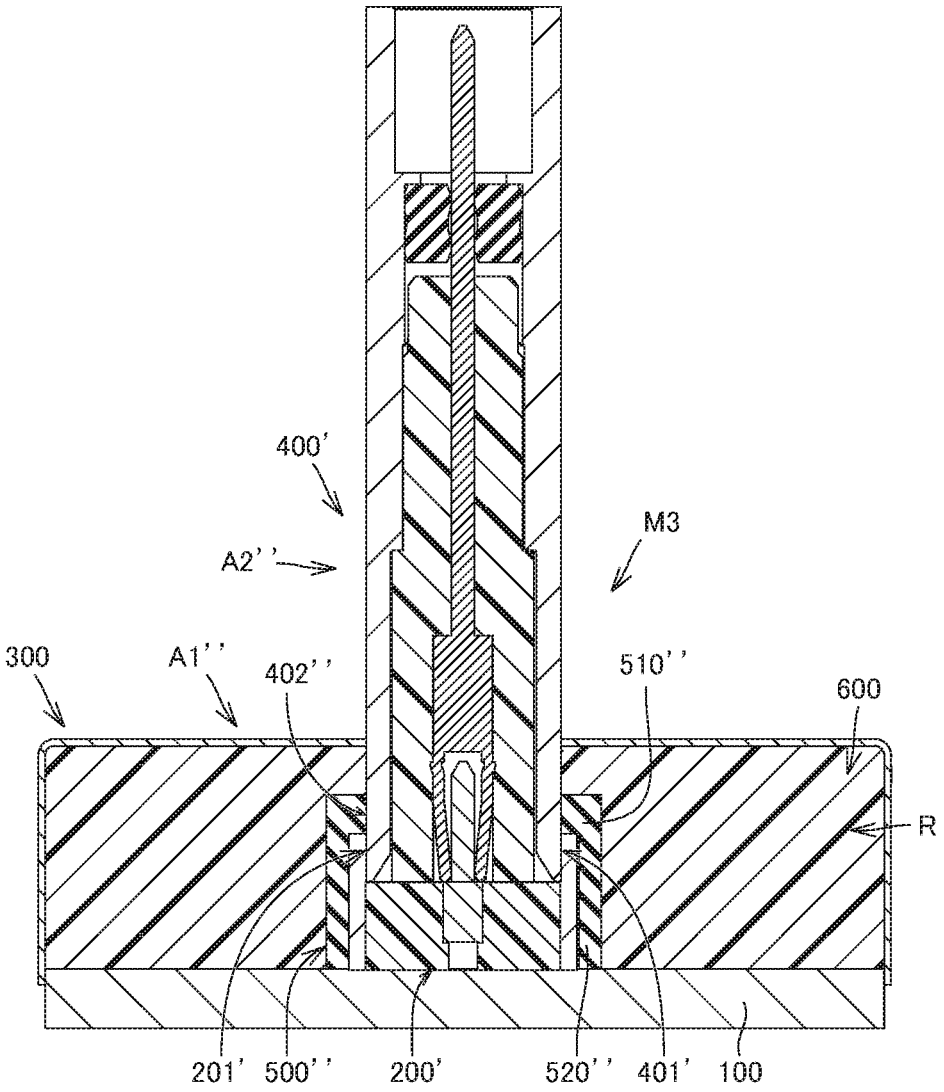
FIG. 7 is a schematic cross-sectional view of a variant connection module of the first or second embodiment.

The first connector may be a male connector, and the second connector may be a female connector as in the above embodiments and their variants. Alternatively, the first connector may be a female connector, and the second connector may be a male connector. An example of such variant is shown in FIG. 7 as a connection module M3 including an assembly A1" and an assembly A2". The assembly A1" includes a first connector 200' with a connection hole 201'. The assembly A2" includes a second connector 400' with a distal portion 401' to be inserted into, or inserted fittingly into, the connection hole 201'. The connection module M3 further includes a sealing member 500", which includes a first portion 510" and a second portion 520" and may have configuration (A) or (B) as follows.

The first portion 510" of the sealing member 500" fits around a portion 402' on the Z-direction side (corresponding to the accommodatable portion) of the distal portion 401' of the second connector 400'. In this case, the second portion 520" of the sealing member 500" is positioned on the Z'-direction side relative to the portion 402' of the second connector 400', abuts the first face 101 of the circuit board 100 within the accommodation space R, and covers and surrounds the first connector 200'. The sealing member 500" may be a separate member from the second connector 400' or may be integrated with the second connector 400'.

(B) The second portion 520" of the sealing member 500" fits around at least part of the first connector 200'. In this case, the first portion 510" of the sealing member 500" is positioned on the Z-direction side relative to the at least part of the first connector 200', and fits around a portion 402' on the Z-direction side (corresponding to the accommodatable portion) of the distal portion 401' of the second connector 400'. The sealing member 500" may be a separate member from the first connector 200' or may be integrated with the first connector 200'.

In either of the above configurations (A) and (B), the first portion 510" of the sealing member 500" may preferably, but is not required to, have inner dimensions that are smaller than those of the second portion 520" of the sealing member 500".

The accommodatable portion of the second connector of the invention need only be configured to be disposed within the accommodation space, and to be fit around, or integrally molded such as to fit around, the first portion of the sealing member of any of the above aspects. The sealing member of the invention may be provided in either the first connector or the second connector as described above, but the invention is not limited thereto. The sealing member of the invention may be fixed such that the second portion abuts the circumference of the first connector as mounted on the circuit board, and that the first portion fits around the accommodatable portion of the second connector.

It should be appreciated that the materials, the shapes, the dimensions, the number, the positions, etc. of the elements of the connection modules and the connector assemblies in the above-described embodiments and their variants are presented by way of example only and can be modified in any manner as long as the same functions can be fulfilled. The aspects and variants of the above-described embodiments can be combined in any possible manner. It should be noted that the first direction of the invention may be any direction that is substantially perpendicular to the circuit board of the invention, or any direction in which the first and the second connectors are connected together.

REFERENCE SIGNS LIST

M1, M2, M3: connection module
A1, A1', A1": first connector assembly
100: circuit board
101: first face
102: second face
110: first electrode
120: second electrode
200, 200': first connector
210: terminal
211: contact portion
212: tail
220: body
221: base
222: distal portion
223: housing portion
230: shell
231: tube
A2, A2', A3': second connector assembly
300: case
310: top plate
311: opening
312: edge
320: side plate
R: accommodation space
400, 400': second connector
410: terminal
411: contact portion
412: tail
420: body
421: housing portion
430: shell
431: wall
432: wall
433: housing room
440: connection hole
450: receiving hole
460: internal seal
461: through hole
500, 500', 500": sealing member
510, 510', 510": first portion
520, 520', 520": second portion
600: thermal-conductive resin

What is claimed is:

1. A connection module comprising:

a circuit board;

a case combined with the circuit board, the case and the circuit board defining an accommodation space;

a first connector mounted on the circuit board and accommodated within the accommodation space;

a second connector passing through the case in a first direction, the first direction being substantially perpendicular to the circuit board, the second connector connecting to the first connector within the accommodation space and including an accommodatable portion disposed within the accommodation space; and a sealing member having a tuboid shape and extending in the first direction, the sealing member including a first and a second portion respectively on one and the other sides in the first direction, the first portion fitting around the accommodatable portion of the second connector, the second portion being positioned on the other side in the first direction relative to the accommodatable portion of the second connector, abutting the circuit board, and covering the first connector; and thermal-conductive resin filling the accommodation space, wherein the first connector, the sealing member, and the accommodatable portion of the second connector are embedded in the thermal-conductive resin.

2. The connection module according to claim 1, wherein the second portion of the sealing member fits around at least part of the first connector, and the first portion of the sealing member is positioned on the one side in the first direction relative to the at least part of the first connector.

3. The connection module according to claim 1, wherein the case includes a top plate and a side plate, the side plate having a tuboid shape, extending from the top plate to the other side in the first direction, and abutting the circuit board, and the second connector passes through the top plate in the first direction.

4. The connection module according to claim 2, wherein the case includes a top plate and a side plate, the side plate having a tuboid shape, extending from the top plate to the other side in the first direction, and abutting the circuit board, and the second connector passes through the top plate in the first direction.

5. The connection module according to claim 1, wherein the first portion of the sealing member is a tuboid end portion on the one side in the first direction of the sealing member, and the second portion of the sealing member is a tuboid end portion on the other side in the first direction of the sealing member.

6. The connection module according to claim 2, wherein the first portion of the sealing member is a tuboid end portion on the one side in the first direction of the sealing member, and the second portion of the sealing member is a tuboid end portion on the other side in the first direction of the sealing member.

7. A method for manufacturing the connection module according to claim 1, the method comprising:

combining a circuit board and a case such that the circuit board and the case define an accommodation space, and connecting, within the accommodation space, a first connector mounted on the circuit board to a second connector passing through the case; and filling the defined accommodation space with liquid thermal-conductive resin, and solidifying the filled thermal-conductive resin, wherein the connecting of the first and second connectors includes bringing a sealing member, which fits around the second connector, into abutment with the circuit board and placing the sealing member such that the sealing member covers and surrounds the first connector on the circuit board.

8. A method for manufacturing the connection module according to claim 2, the method comprising:

combining a circuit board and a case such that the circuit board and the case define an accommodation space, and connecting, within the accommodation space, a first connector mounted on the circuit board to a second connector passing through the case; and filling the defined accommodation space with liquid thermal-conductive resin, and solidifying the filled thermal-conductive resin, wherein the connecting of the first and second connectors includes placing a sealing member, which fits around the first connector and abuts the circuit board, such that the sealing member fits around the second connector.

9. A method for manufacturing the connection module according to claim 2, the method comprising:

inserting a second connector into an opening of a case, the case being combined with a circuit board on which a first connector is mounted, the case and the circuit board defining an accommodation space, and connecting the second connector to the first connector within the accommodation space; and filling the defined accommodation space with liquid thermal-conductive resin, and solidifying the filled thermal-conductive resin, wherein the connecting of the first and second connectors includes placing a sealing member, which fits around the first connector and abuts the circuit board, such that the sealing member fits around the second connector.

10. The connection module according to claim 1, wherein the first portion of the sealing member is integrated with the accommodatable portion of the second connector.

11. The connection module according to claim 1, wherein the sealing member is made of an elastic material.

12. The connection module according to claim 1, wherein the case includes a top plate and a side plate, the side plate having a tuboid shape and extending from the top plate to the other side in the first direction, the second connector passes through the top plate in the first direction, and the accommodatable portion of the second connector is disposed inside the case.

13. The connection module according to claim 1, wherein the first portion of the sealing member is a tuboid end portion on the one side in the first direction of the sealing member, and the second portion of the sealing member is a tuboid end portion on the other side in the first direction of the sealing member.

14. A connection module comprising:

a circuit board;

a case combined with the circuit board, the case and the circuit board defining an accommodation space;

a first connector mounted on the circuit board and accommodated within the accommodation space;

a second connector passing through the case in a first direction, the first direction being substantially perpendicular to the circuit board, the second connector connecting to the first connector within the accommodation space and including an accommodatable portion disposed within the accommodation space;

a sealing member having a tuboid shape and extending in the first direction, the sealing member including a first portion and a second portion, respectively, on one and the other sides in the first direction, the second portion fitting around at least part of the first connector and abutting the circuit board, the first portion being positioned on the one side in the first direction relative to the at least part of the first connector and fitting around the accommodatable portion of the second connector; and thermal-conductive resin filling the accommodation space, wherein the first connector, the sealing member, and the accommodatable portion of the second connector are embedded in the thermal-conductive resin.

15. The connection module according to claim 14, wherein the second portion of the sealing member is integrated with the at least part of the first connector.

16. The connection module according to claim 14, wherein the sealing member is made of an elastic material.

17. The connection module according to claim 14, wherein the case includes a top plate and a side plate, the side plate having a tuboid shape and extending from the top plate to the other side in the first direction, the second connector passes through the top plate in the first direction, and the accommodatable portion of the second connector is disposed inside the case.

18. The connection module according to claim 14, wherein the first portion of the sealing member is a tuboid end portion on the one side in the first direction of the sealing member, and the second portion of the sealing member is a tuboid end portion on the other side in the first direction of the sealing member.

* * * * *